US007017541B2

(12) United States Patent
Inaba et al.

(10) Patent No.: US 7,017,541 B2
(45) Date of Patent: Mar. 28, 2006

(54) DRIVING APPARATUS AND VALVE LIFT ADJUSTING APPARATUS USING THE SAME

(75) Inventors: Hideo Inaba, Okazaki (JP); Akira Shibata, Anjo (JP)

(73) Assignee: Denso Corporation, (JP)

( * ) Notice: Subject to any disclaimer, the term of this patent is extended or adjusted under 35 U.S.C. 154(b) by 0 days.

(21) Appl. No.: 10/986,284

(22) Filed: Nov. 12, 2004

(65) Prior Publication Data

US 2005/0120987 A1 Jun. 9, 2005

(30) Foreign Application Priority Data

Nov. 11, 2003 (JP) ..... 2003-380974

(51) Int. Cl.
*F01L 1/34* (2006.01)

(52) U.S. Cl. ..... 123/90.18; 123/90.15; 123/90.17; 123/90.31; 123/90.16

(58) Field of Classification Search ..... 123/90.16, 123/90.18, 90.15, 90.17, 90.31
See application file for complete search history.

(56) References Cited

U.S. PATENT DOCUMENTS

| | | | | |
|---|---|---|---|---|
| 6,328,006 | B1 * | 12/2001 | Heer | 123/90.15 |
| 6,425,357 | B1 * | 7/2002 | Shimizu et al. | 123/90.16 |
| 2001/0023674 | A1 | 9/2001 | Shimizu et al. | 123/90.18 |
| 2004/0083997 | A1 | 5/2004 | Shibata et al. | 123/90.16 |

* cited by examiner

*Primary Examiner*—Thomas Denion
*Assistant Examiner*—Zelalem Eshete
(74) *Attorney, Agent, or Firm*—Nixon & Vanderhye PC

(57) ABSTRACT

A driving cam includes a circular surface portion at an outer cam surface thereof. When an engine is turned off, the circular surface portion is brought into contact with a roller. Thereby, even if a load is applied to the control axis member, no rotational force is circumferentially applied to the driving cam. As the result, even if a driving force is not applied from a motor to the driving cam, a rotational angle of the driving cam and an axial position of the control axis member are kept constant. Therefore, it is possible to keep the driving cam and the control axis member at a constant position without adding a complicated mechanism.

11 Claims, 3 Drawing Sheets

DRIVING APPARATUS AND VALVE LIFT ADJUSTING APPARATUS USING THE SAME

CROSS-REFERENCE TO RELATED APPLICATION

This application is based on Japanese Patent Application No. 2003-380974 filed on Nov. 11, 2003, the disclosure of which is incorporated herein by reference.

FIELD OF THE INVENTION

The present invention relates to a driving apparatus which converts a rotational motion of a driving power source into a reciprocating motion of a control axis member, and a valve lift adjusting apparatus using the driving apparatus. The present invention can be used as a valve lift adjusting apparatus for an internal combustion engine.

BACKGROUND OF THE INVENTION

JP-2001-263015A shows a driving apparatus which adjusts a control amount of the controlled member according to an axial position of the control axis member. The driving apparatus is slidably supported by a shaft which is different from a camshaft of a valve cam, and is provided with an intermediate driving mechanism which transfers a driving force of the valve cam to an intake valve and/or an exhaust valve. Thereby, a reciprocating motion of the control axis member is converted to a rotational motion, and a relative lift amount difference between the valve cam of the intermediate driving mechanism and the intake valve and/or the exhaust valve according to an axial position of the control axis member.

For instance, when the driving apparatus is adapted to adjust a valve lift of the internal combustion engine, the control axis member always receives a one-way load. On the other hand, in order to keep a predetermined valve lift amount at the starting of engine for example, it is desirable that the control axis member be positioned according to a predetermined valve lift amount. However, in order to keep the position of the driving cam at a constant position, it is necessary to constantly add a driving force from the driving power source to the camshaft driving the driving cam, or to provide a complicated mechanism such as an electromagnetic clutch.

SUMMARY OF THE INVENTION

An object of the present invention is provide a driving apparatus and a valve lift adjusting apparatus which can keep the driving cam at a constant position without constantly applying a driving force to the driving cam and providing a complicated mechanism.

According to the present invention, a driving cam has a circumferential surface at an outer cam surface. The circumferential surface has a constant radius in a predetermined circumferential length. Thus, when the circumferential surface is in contact with a contacting portion, the driving cam does not rotate except when the driving force is applied to the driving cam. That is, when the circumferential surface is in contact with the contacting portion, a rotation of the driving cam is locked. Thus, when a load is applied to the control axis member, even if a driving force from the driving power source is not applied to the driving cam through camshaft, a driving cam and the control axis member can be positioned at constant positions, the axial position of the control axis member being controlled by the driving cam.

DETAILED DESCRIPTION OF EMBODIMENT

Embodiments of the present invention will be described hereinafter with reference to the drawings.

Figure 1:
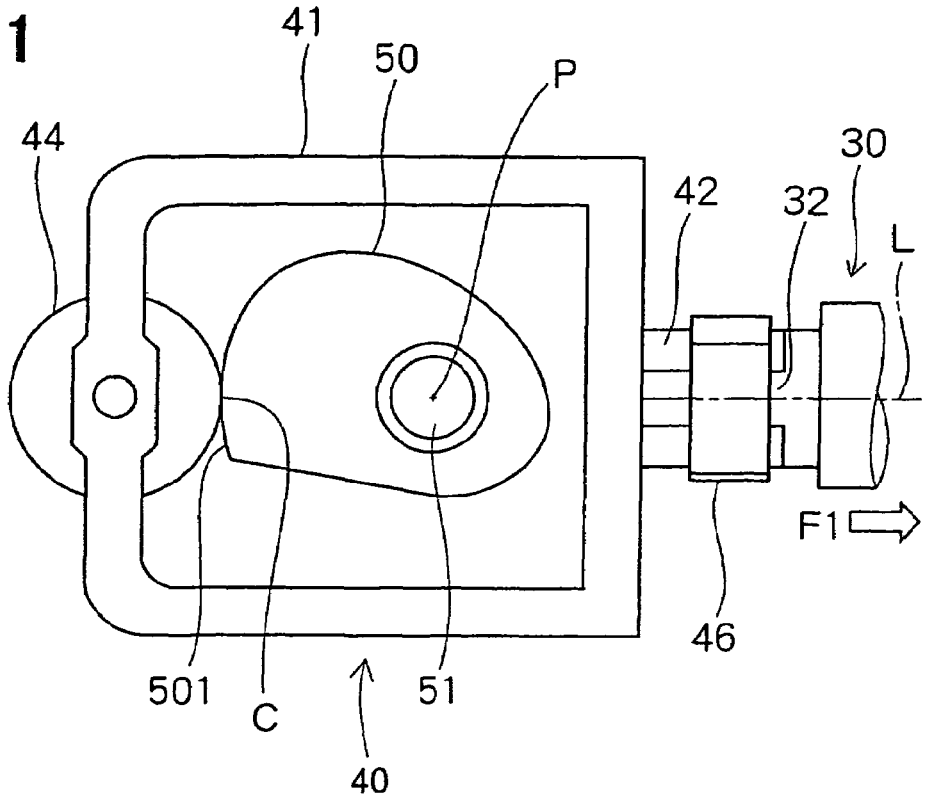
FIG. 1 is a schematic view showing an essential part of the driving apparatus according to an embodiment of the present invention.
Figure 2:
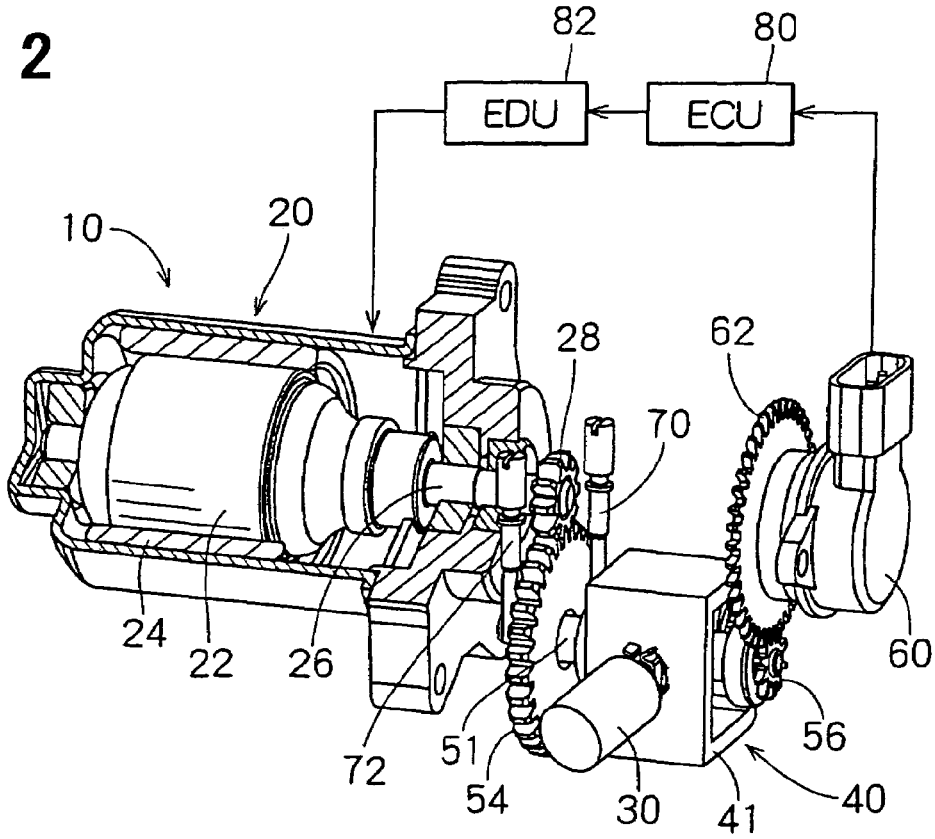
FIG. 2 is a partially cross-sectional perspective view of the driving apparatus according to the embodiment of the present invention.
Figure 3:
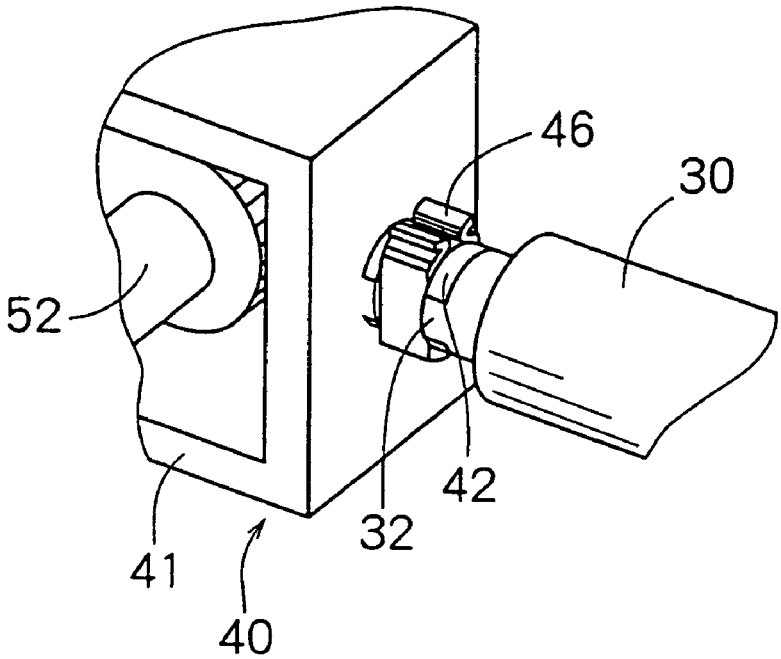
FIG. 3 is a perspective view of a connecting part of the control axis member of the driving apparatus and a transfer portion according to the embodiment.

FIGS. 1, 2, and 3 show a driving apparatus according to an embodiment of the present invention. The driving apparatus 10 of the present embodiment is used as a valve lift adjusting apparatus which adjusts a relative lift difference between a valve cam driving an intake valve and the intake valve based on, for instance, an axial position of a control axis member 30.

The driving apparatus shown in FIG. 2 comprises a motor 20 as a driving power source, the control axis member 30, a transfer portion 40, a driving cam 50 (refer to FIG. 1), an angle sensor 60, an electric control unit (ECU) 80, and a driving circuit (EDU) 82. The motor 20 is a DC-motor, which comprises a rotor 22 on which a coil is wound, and a permanent magnet 24 which covers an outer surface of the rotor 22. A motor gear 28 is provided at an end of a shaft 26 of the motor 20, which rotates with the rotor 22.

The control axis member 30 is connected to a supporting frame 41 of the transfer portion 40 at one end thereof, and is connected to a lift adjusting means at the other end thereof. The control axis member 30 is crossing substantially perpendicularly to the shaft 26 of the motor 20. As shown in FIGS. 1, 3, a connecting portion 32, which is one end of the control axis member 30, is engaged with and connected to a connecting portion 42 of the supporting frame 41. A clip 46 is provided between the connecting portion 32 and the connecting portion 42. The clip 46 connects the connecting portion 32 to the connecting portion 42.

The transfer portion 40 comprises the supporting frame 41 which is square box-shaped, and a roller 44 which is supported by the supporting frame 41 at an opposite side relative to the control axis member 30. A camshaft member 51 is inserted into the inside of the supporting frame 41. The driving cam 50 rotates with the cam axis member 51, being in contact with the roller 44. As shown in FIG. 2, a cam gear 54 and a cam gear 56 are respectively provided at both ends of the camshaft member 51. The cam gear 54 engages with the motor gear 28. The cam axis member 51 is disposed in parallel to the shaft 29 of the motor 20.

Figure 4:
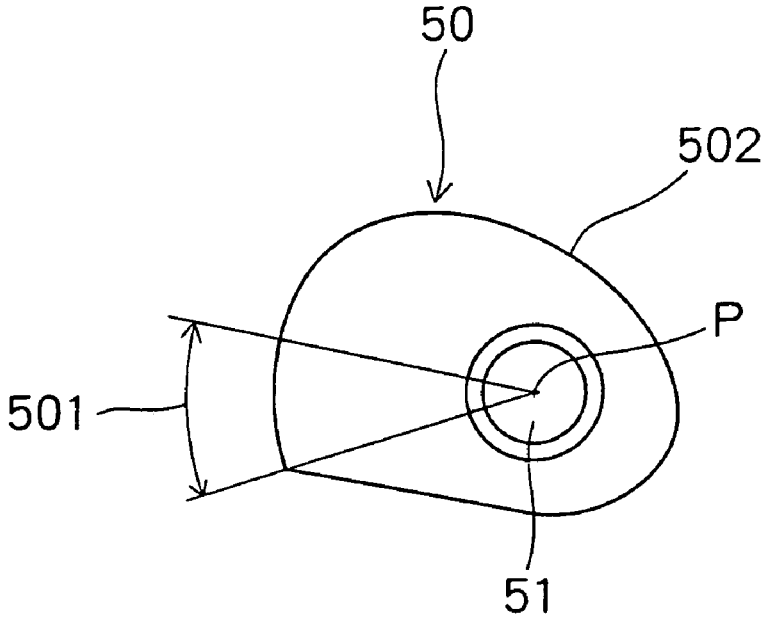
FIG. 4 is a schematic vie of a driving cam of the driving apparatus according to the embodiment.

As shown in FIG. 4, the driving cam 50 includes an outer curved cam surface and a flat non-cam surface. The outer cam surface comprises a circular surface portion 501 and an arbitrarily curved surface portion 502. A center point of the circular surface portion 501 is a center axis P of the camshaft member 51. The circular surface portion 501 is a part of a circle which is a concentric circle of the outer surface of the cam shaft member 51. On the other hand, the arbitrarily curved surface portion 502 has an outer periphery in a cross section perpendicular to the center axis, which is an arbitrarily curved required to a characteristic of the driving cam 50, such as an involute circle and a trochoid circle. In this embodiment, the circular surface portion 501 is formed at an end portion in a circumferential direction of outer cam surface of the driving cam 50.

Figure 5:
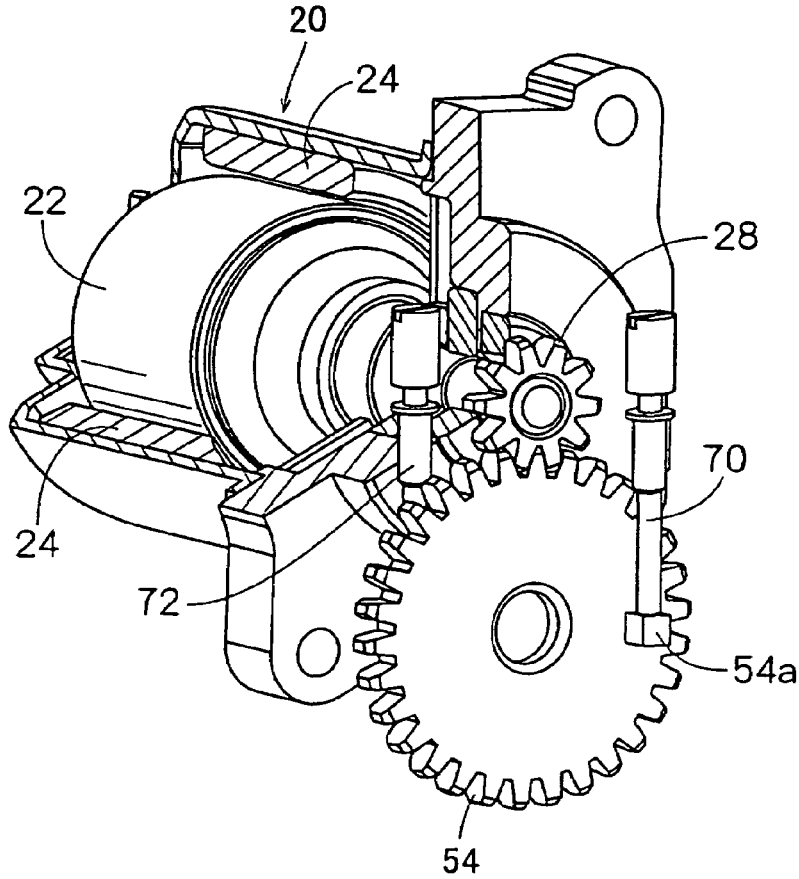
FIG. 5 is a perspective view showing a protruding portion of the driving apparatus according to the embodiment.

As shown in FIG. 5, a protrusion 54*a* is formed at one end surface of the cam gear 54 in an axial direction thereof. When the protrusion 54*a* is engaged with a shaft 70, the motor 20 stops. The cam gear 54 has the other protrusion (not shown) at the other end surface thereof where is opposite side relative to the protrusion 54*a*. When this protrusion is engaged with a shaft 72, the motor 20 stops. Two protrusions are engaged with the shafts 70, 72, whereby a rotation angle range of the driving cam 50 is restricted to a predetermined angle range.

The angle sensor 60 shown in FIG. 2 has a sensor gear 62 which engages with the cam gear 56. The angle sensor 60 detects a rotation angle of a sensor rotation member (not shown) engaging with the sensor gear 62 with the sensor rotation member and a non-contacting Hall effect element. The ECU 80 receives a detected signal of the angle sensor 60 and other detected signals of sensors such as acceleration opening, and outputs a control signal to the EDU 82 which drives the motor 20 based on the input sensor detected signals.

An operation of the driving apparatus 10 is described hereinafter.

When the motor 20 starts rotating, a torque of the motor 20 is transferred to the camshaft member 51 and a driving cam 50 through the cam gear 54. When the driving cam 50 rotates, the supporting flam 41 supporting the roller 44 which is in contact with the driving cam 50 reciprocates in the axial direction of the control axis member 30. The control axis member 30 reciprocates with the supporting frame 41 in a direction which is substantially perpendicular to the shaft 26 of the motor 20. The lift adjusting means of the valve lift adjusting apparatus adjusts the relative valve lift amount of the intake valve relative to the valve cam according to an axial position of the control axis member 30 which moves along the cam profile of outer cam surface of the driving cam 50. The control axis member 30 adjusts the difference of the relative lift amounts between the valve cam and the intake valve, receiving a load as a reaction force from the intake valve. In this embodiment, a load is applied to the control axis member 30 in a direction illustrated by an arrow F1 in FIG. 1, that is the direction in which the control axis member 30 pulls the driving cam 50.

When the engine stops running, the ECU 80 drive the motor 20 50 that the circular surface portion 501 of the driving cam 50 is in contact with the roller 44. Thus, when the engine stops, the circular surface portion 501 of the driving cam 50 is in contact with the roller 44. In this moment, a center axis L of the control axis member 30, a center axis P of the driving cam 50 and the cam shaft member 51, and a contacting point C of the circular surface portion 501 of the driving cam 50 and the roller 44 are lined in a same line. Since the circular surface portion 501 of the driving cam 50 is in contact with the roller 44, and the center axis L, the center axis P and the contacting point C are on the same line, no rotational force is applied to the driving cam 50. Thereby, when the circular surface portion 501 is in contact with the roller 44, the driving cam 50 is in a position in which the circumferential rotation thereof is locked. As the result, even if a force is applied to the control axis member 3 in an opposite direction relative to the supporting frame and no driving force is transmitted from the motor 20, the driving cam 50 is locked, engaging with the roller 44. By locking the driving cam 50, movements of the driving cam 50 and the control axis 30 are restricted, and the driving cam 50 and the control axis member 30 are kept at constant positions. At this time, the control axis member 30 is kept at a position which corresponds to a valve lift amount at the engine starting. Therefore, when the engine starts, the valve lift of the intake valve is set proper for starting the engine without the operation of the driving apparatus 10 by the motor 20.

In the embodiment described above, the driving cam 50 has the circular surface portion 501, which is a concentric circle around a center of the camshaft member 51, at its outer cam surface. When the engine is off, the circular surface portion 501 of the driving cam 50 come in contact with the roller 44. Thereby, even if the load is applied to the control axis member 30, no circumferential rotating force is applied to the driving cam 50. As the result, even if a driving force is not transmitted from the motor 20 to the driving cam 50, the rotational angle of the driving cam 50 and the axial position of the control axis member 30 are kept constant. Thus, without adding a complicated mechanism, the positions of the driving cam 50 and the control axis member 30 can be kept constant. Besides, it is unnecessary to continuously supply the electricity to the motor 20 in order to keep the rotational angle of the driving cam 50 and the axial position of the control axis member 30 constant. Thus, the consumed electricity by the motor 20 can be reduced.

Furthermore, in this embodiment of the present invention, by keeping the positions of the driving cam 50 and the control axis member 30 constant, the valve lift amount of the intake valve is set a proper amount at the re-stating of the engine without the operation of the driving apparatus 10. Thus, the startability of the engine and the fuel economy are improved.

(The Other Embodiment)

The other embodiment of the present invention is described hereinafter. The same parts as those in the embodiment described above are indicated with the same numerals and the same descriptions will not be reiterated.

Figure 6:
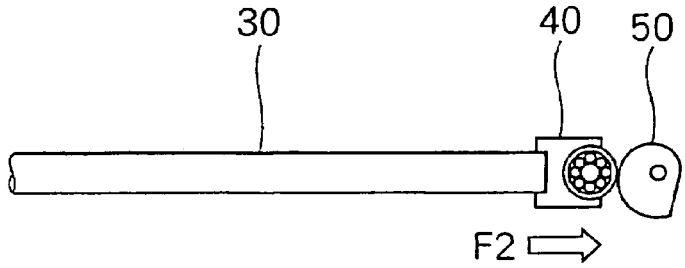
FIG. 6 is a schematic view showing an essential part of the driving apparatus according to another embodiment of the present invention.

In the embodiment described above, the force shown by the arrow F1 in FIG. 1 is applied to the control axis member 30 in direction away from the driving cam 50. However, as shown in FIG. 6, a force toward the driving cam 50 shown by an arrow F2 in FIG. 6, that is, a force that the control axis member 30 urges the driving cam 50 can be applied to the control axis member 50 in the present invention. Thereby, the driving cam 50 and the control axis member 30 cam can be kept constant positions.

Figure 7:
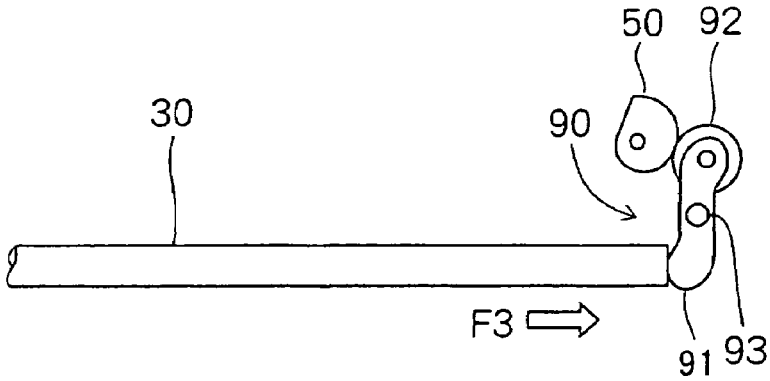
FIG. 7 is a schematic view showing an essential pat of the driving apparatus according to the other embodiment of the present invention.

Besides, as shown in FIG. 7, a driving force can be transferred from the driving cam 50 to the control axis member 30 through a link mechanism 90. In FIG. 7, a load is applied to the control axis member 30 in a direction shown by an arrow F3. The link mechanism 90 includes an arm 91 and a contacting member 92. The arm 91 is rotatably supported on a supporting portion 93. One end of the arm 91 is in contact with one end of the control axis member 130. The contacting member 92 is in contact with the driving cam

50. Thus, the arm 91 is pivoted by the driving cam 50 through the contacting member 91. As the result, the control axis member 130 moves in an axial direction thereof.

Therefore, the driving cam 50 is connected with the control axis member 30 through the link mechanism 90. Even if the driving cam 50 is not directly in contact with the control axis member 30, the positions of the driving cam 50 and the control axis member 30 are kept at a constant position according to the present invention.

In the above embodiment, the DC-motor is used as the power source. However, the power source is not limited to the DC-motor. The other electric motor, such as AC-motor can be used as the power source. Not only the electric motor but also an actuator using an oil pressure, a compressed air, and electromagnetic force can be used as the power source. Furthermore, in the embodiments of the invention, the valve lift adjusting apparatus is applied as a controlled part which is driven by the driving apparatus. The controlled part is not limited to the valve lift adjusting apparatus.

What is claimed is:

1. A driving apparatus adjusting a control amount of a controlled part based on an axial position of a control axis member, comprising:

a driving cam including a circular surface portion and a non-circular surface portion, the circular surface portion having a constant radius over a predetermined circumferential length of an outer cam surface, the driving cam rotating with a cam shaft member by a driving force received from a power source;

a control axis member substantially perpendicular to a rotational axis of the cam shaft member, the control axis member reciprocating in a direction substantially perpendicular to the rotational axis of the cam shaft member along a profile of the outer cam surface while the driving cam rotates; and a transfer portion disposed at one end of the control axis member, having a contact portion being in contact with the driving cam, and converting a rotational motion of the driving cam into a reciprocating motion which is transferred to the control axis member, wherein a radial distance between a center of the camshaft and the circular surface portion is longer than a radial distance between the center of the cam shaft and the non-circular surface portion.

2. The driving apparatus according to claim 1, wherein the power source includes an electric motor.

3. The driving apparatus according to claim 1 or 2, wherein the circular surface portion is a concentric circle with the cam shaft member.

4. The driving apparatus according to claim 1, wherein the circular surface portion is formed at a circumferential end of the driving cam.

5. A valve lift adjusting apparatus comprising:

a driving cam having a circular surface portion and a non-circular surface portion, the circular surface portion being defined over a predetermined circumferential length of an outer cam surface, the driving cam rotating with a cam shaft member by a driving force received from a power source;

a control axis member substantially perpendicular to a rotational axis of the cam shaft member, the control axis member reciprocating in a direction substantially perpendicular to the rotational axis of the cam shaft member along a profile of the outer cam surface while the driving cam rotates, wherein a load is applied to the control axis member and the driving cam;

a transfer portion disposed at one end of the control axis member, having a contact portion being in contact with the driving cam, and converting a rotational motion of the driving cam into a reciprocating motion which is transferred to the control axis member; and a valve lift adjusting mean for adjusting a lift amount of an intake valve or an exhaust valve relative to a valve cam driving the intake valve or the exhaust valve based on an axial position of the control axis member, wherein a radial distance between a center of the camshaft and the circular surface portion is longer than a radial distance between the center of the cam shaft and the non-circular surface portion.

6. The valve lift adjusting apparatus as in claim 5, wherein the circular surface portion is concentric with the cam shaft member.

7. The valve lift adjusting apparatus as in claim 5, wherein said circular surface portion is a farthest portion from the center of the cam shaft on said outer cam surface.

8. The driving apparatus according to claim 1, wherein the driving cam further includes a flat, non-cam surface portion.

9. The driving apparatus according to claim 1, wherein the driving cam is in direct contact with the control axis member.

10. The driving apparatus according to claim 1, wherein the driving cam is indirectly contacted with the control axis member through a link mechanism.

11. The driving apparatus according to claim 1, wherein said circular surface portion is a farthest portion from the center of the cam shaft on said outer cam surface.

* * * * *